US007320224B2

(12) United States Patent
Ash et al.

(10) Patent No.: US 7,320,224 B2
(45) Date of Patent: Jan. 22, 2008

(54) METHOD AND APPARATUS FOR DETECTING AND MEASURING STATE OF FULLNESS IN CRYOPUMPS

(75) Inventors: Gary S. Ash, Dartmouth, MA (US); Allen J. Bartlett, Milford, MA (US); James A. O'Neil, Bedford, MA (US); Bruce R. Andeen, Boxborough, MA (US)

(73) Assignee: Brooks Automation, Inc., Chelmsford, MA (US)

( * ) Notice: Subject to any disclaimer, the term of this patent is extended or adjusted under 35 U.S.C. 154(b) by 354 days.

(21) Appl. No.: 10/763,056

(22) Filed: Jan. 21, 2004

(65) Prior Publication Data

US 2005/0155358 A1 Jul. 21, 2005

(51) Int. Cl.
*B01D 8/00* (2006.01)

(52) U.S. Cl. ..... 62/55.5

(58) Field of Classification Search ..... 62/55.5
See application file for complete search history.

(56) References Cited

U.S. PATENT DOCUMENTS

| | | | | |
|---|---|---|---|---|
| 3,850,040 | A | | 11/1974 | Orr, Jr. et al. |
| 4,489,593 | A | | 12/1984 | Pieters et al. |
| 4,555,907 | A | | 12/1985 | Bartlett |
| 4,580,404 | A | | 4/1986 | Pez et al. |
| 4,593,530 | A | | 6/1986 | Longsworth |
| 4,662,181 | A | | 5/1987 | Brigham |
| 4,785,666 | A | | 11/1988 | Bergquist |
| 4,873,833 | A | * | 10/1989 | Pfeiffer et al. ..... 62/55.5 |
| 5,014,517 | A | * | 5/1991 | Larin et al. ..... 62/55.5 |
| 5,211,022 | A | | 5/1993 | Bartlett et al. |
| 5,239,482 | A | | 8/1993 | Ajot et al. |
| 5,343,740 | A | | 9/1994 | Myneni |
| 5,400,604 | A | * | 3/1995 | Hafner et al. ..... 62/55.5 |
| 5,443,368 | A | | 8/1995 | Weeks et al. |
| 5,672,325 | A | | 9/1997 | Hiratsuka et al. |
| 5,906,102 | A | | 5/1999 | Bartlett et al. |
| 5,932,797 | A | | 8/1999 | Myneni |
| 6,122,921 | A | | 9/2000 | Brezoczky et al. |
| 6,216,467 | B1 | | 4/2001 | O'Neil et al. |
| 6,272,400 | B1 | | 8/2001 | Jankins et al. |
| 6,427,969 | B1 | | 8/2002 | Ho et al. |
| 6,895,766 | B2 | * | 5/2005 | Amundsen et al. ..... 62/55.5 |

* cited by examiner

*Primary Examiner*—Melvin Jones
(74) *Attorney, Agent, or Firm*—Hamilton, Brook, Smith & Reynolds, P.C.

(57) ABSTRACT

The present system and method provides a mechanism for monitoring the level of fullness of a cryopump by measuring the cryopump adsorption capacity. An ion gauge or other total pressure gauge is in contact with the condensing or adsorbing panels of the pump. The gauge sensor, for example, can be connected to a tube or duct leading to the central core of the pump where the adsorbing charcoal is located. At this location in the pump, the gauge is exposed to low-boiling-point gases, such as hydrogen, neon and helium, while being substantially shielded from other gases such as nitrogen, argon, oxygen, or water vapor. By connecting a gauge to this location of the pump, the gauge can be used to monitor the absorption capacity of the pump.

66 Claims, 6 Drawing Sheets

METHOD AND APPARATUS FOR DETECTING AND MEASURING STATE OF FULLNESS IN CRYOPUMPS

BACKGROUND

In semiconductor wafer fabrication processes, it is common to incorporate vacuum pumps to exhaust different types and concentrations of gases from process chambers. Cryogenic vacuum pumps (cryopumps) are often employed to evacuate gases from process chambers because they generally permit higher pumping speeds than other vacuum pumps. Cryopumps store most gases as solids condensed on the cryogenic surfaces of the pump or through cryogenic adsorption. High-boiling-point gases such as water vapor are condensed on the frontal array, while low-boiling-point gases, namely hydrogen, helium and neon, pass through the radiation shield and adsorb on the cryogenic surfaces of the pump. These surfaces may be coated with an adsorbent such as charcoal or a molecular sieve to adsorb the low-boiling-point gases.

After several days or weeks of use, the gases that are condensed onto the cryopanels, and in particular the gases that are adsorbed, accumulate and begin to saturate the cryopump. As the hydrogen accumulates on the pumping surfaces, the ultimate pressure for cryosorption pumping increases with time. This decreases the pumping capacity and speed of the pump. A regeneration procedure usually follows in order to warm the cryopump and release and remove the gases from the system. The pump, however, should only undergo regeneration when necessary because the typical regeneration process takes time during which the manufacturing or other process for which the cryopump creates a vacuum must idle. Therefore, it is desirable to determine exactly when the pump needs to be regenerated, and this can be facilitated by monitoring or predicting the absorption capacity of the pump. This factor is dependent upon the amount of adsorbent in the pump and is important because it determines the duration of running time between regenerations.

A mass spectrometer or quadrupole residual gas analyzer (RGA) can be used to monitor the adsorption capacity. These instruments, however, can be difficult to use because, among other things, the interpretation of the data output is often complex and ambiguous. Usually, the user needs to be familiar with the pattern in the spectrum to recognize the mass peaks detected to determine the pressure exerted by one gas in a mixture of gases. They are also relatively expensive devices.

The currently available mass spectrometer and RGA instruments do not fully achieve a cost effective, user-friendly, quick, simple and efficient solution for obtaining information about the adsorption capacity of low-boiling-point gases in a cryopump.

SUMMARY

The present invention is generally related to a system and method for monitoring the fullness state of a cryopump by measuring when the adsorption capacity of a cryopump is reached. This is achieved by mounting an ion gauge or other total pressure gauge on a pump vessel with restricted access to the pump volume. For example, the gauge sensor can be connected to a tube or duct leading to the central core of the pump where the adsorbing charcoal is located. At this location in the pump, the gauge is shielded from other gases such as nitrogen, argon, oxygen, or water vapor. The surfaces holding the charcoal are shielded from these other gases by the highly efficient condensation process. Differences in partial pressure from outside the charcoal array to inside the charcoal array may be two to six or more orders of magnitude. Thus, a gauge sensor that is nominally sensitive to all gases will be exposed only to the low-boiling-point gases. The sensor can thus measure the low-boiling-point gas pressure during process and recovery, independent of the actual chamber or pump total pressure.

The gauge sensor measures total pressure in a region of a cryopump where only non-condensable gases (i.e. low-boiling-point gases) are present. The gauge is directly exposed to the low-boiling-point gases, such as hydrogen, neon and helium, while being shielded from other gases such as nitrogen, argon, oxygen, or water vapor. As a result, the pressure measured actually reflects the pressure of only the low-boiling-point gases in the pump.

With a standard ion gauge, for example, the invention can measure and predict when the adsorption capacity of a cryopump is reached. For instance, a rise of the indicated pressure during recovery to a predetermined level might signify that the pump had reached capacity. In addition, all of the low-boiling-point gases can be monitored at once, which is desirable. The gauge may be in fluid communication with a vacuum region behind the condensing surface of the pump. The gauge may be in fluid communication with a vacuum region enclosed by the condensing surfaces of the pump.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

A description of preferred embodiments of the invention follows.

Cryogenic Vacuum System

Figure 1:
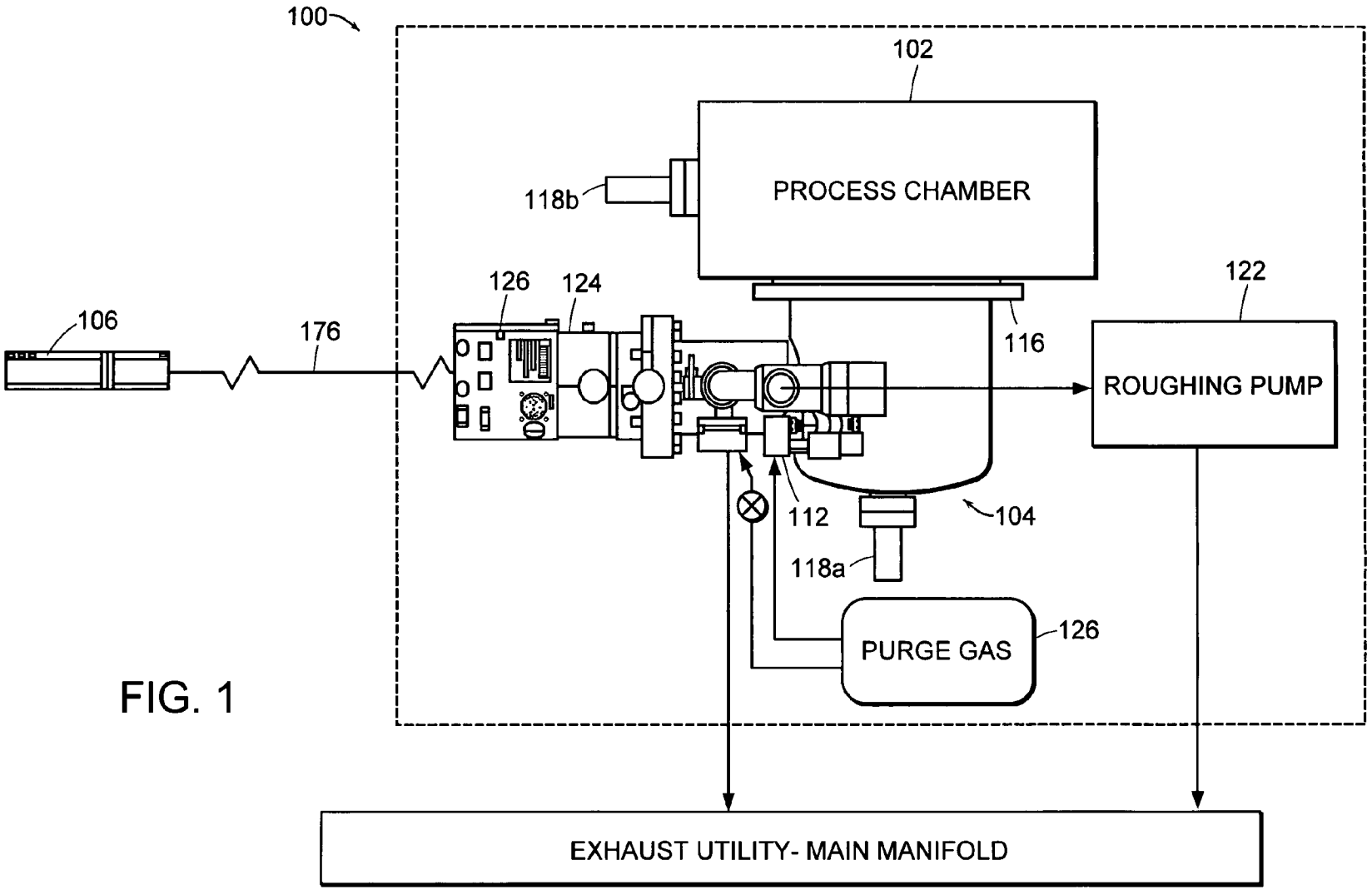
FIG. 1 is a diagram of a cryopump according to an embodiment of the present invention.

FIG. 1 is a diagram of a cryogenic vacuum system 100 according to an embodiment of the present invention. The cryogenic vacuum system 100 is coupled to a process chamber 102 for evacuating gases from the chamber 102. The cryogenic vacuum system 100 includes at least one cryogenic vacuum pump (cryopump) 104 and usually at least one compressor (not shown) for supplying compressed gas to the cryopump 104. The cryogenic vacuum system 100 may also include roughing pump 122, water pumps, turbopumps, chillers, valves 112, 114, 116, and ion gauges 1118*a*, 118*b*. Together, these components operate to evacuate a broader system, such as a tool for semiconductor processing.

The tool may include a tool host control system 106 providing a certain level of control over the systems within the tool, such as the cryogenic vacuum system 100. The tool can use the processing chamber 102 for performing any one of various semiconductor-fabrication processes such as ion implantation, wafer etching, chemical or plasma vapor deposition, oxidation, sintering, and annealing. These processes often are performed in separate chambers, each of which may include a cryopump 104 of a cryogenic vacuum system 100.

Figure 2:
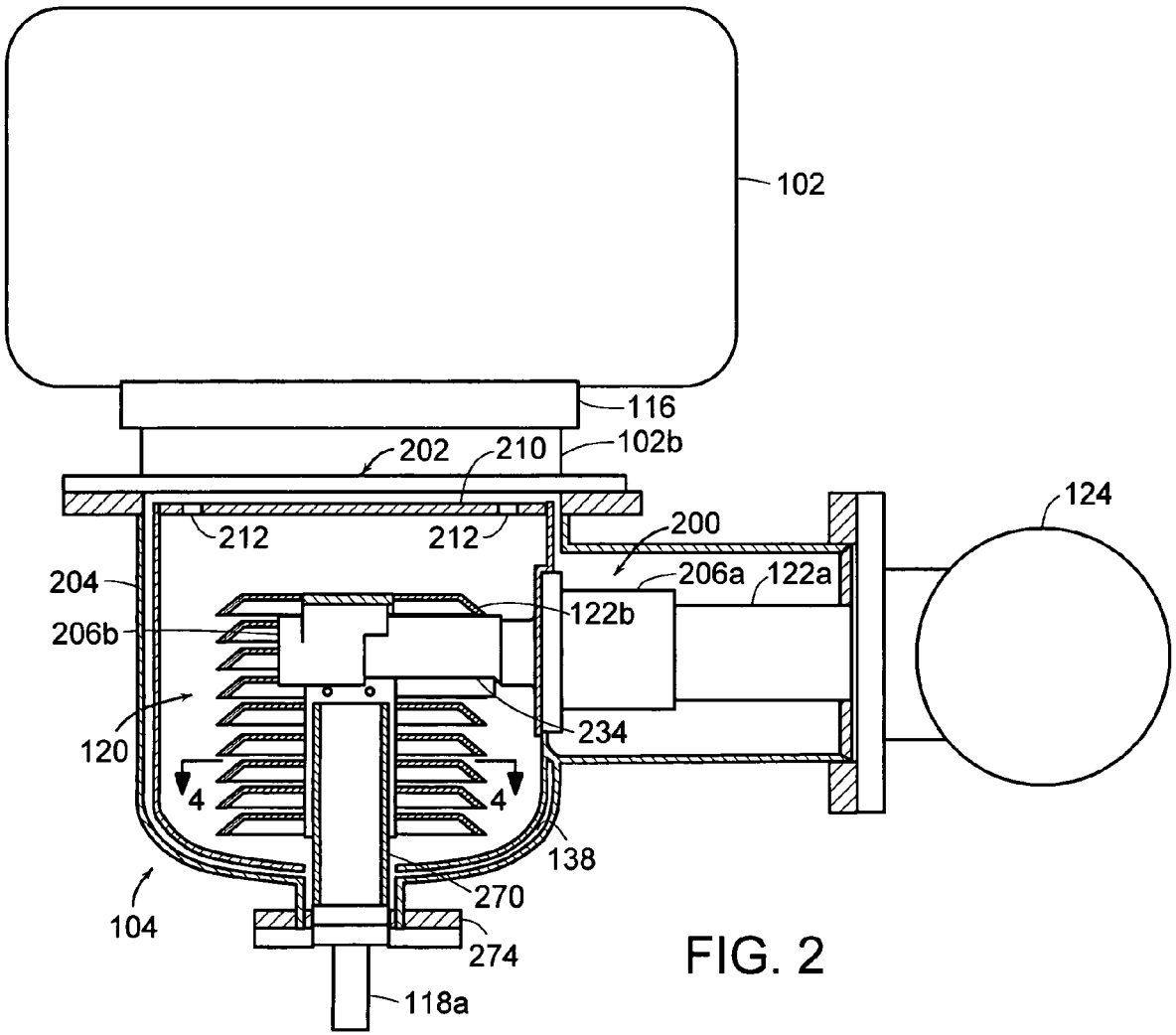
FIG. 2 is a longitudinal cross-sectional view of a cryopump system according to an embodiment of the present invention.

FIG. 2 is a longitudinal cross-sectional view of a cryopump system according to an embodiment of the present invention. The cryopump 104 includes a housing 204 bolted to a conduit 102*b* which is mounted to the process chamber 102. A front opening 202 in the vessel 204 communicates with a circular opening in the process chamber 102. The cryopump 104 can remove gases from the process chamber 102 by freezing the gas molecules on low-temperature cryopanels inside the cryopump 104, and thus producing a high vacuum.

The cryopump 104 is typically a two stage pump with first and second stages 122*a*, 122*b*. A first stage 122*a* has a first stage frontal array with cryopumping surfaces or cryopanels 210 that extend from a radiation shield 138 for condensing high-boiling-point gases such as water vapor. A second stage 122*b* has a second stage array 120 with cryopumping surfaces or cryopanels for condensing low-boiling-point gases. The second stage array cryopanels 120 may include an adsorbent, such as activated charcoal, for adsorbing low-boiling-point gases (e.g. hydrogen). A two stage cold finger 200 of a refrigerator protrudes into the vessel 204. The refrigerator may be a Gifford-MacMahon refrigerator as in U.S. Pat. No. 3,218,815. A two stage displacer in the cold finger 200 is driven by a motor 124. With each cycle, helium gas introduced into the cold finger under pressure is expanded and thus cooled and then exhausted through a relief valve (not shown). A first stage heat sink or heat station 206*a* is mounted at the end of the cold end of the first stage 122*a* of the refrigerator. Similarly, a heat sink 206*b* is mounted to the cold end 234 of the second stage 122*b*.

An array of baffles mounted to the second stage heat station 206*b* is the primary pumping surface. This array is preferably held at a temperature below 20 K in order to condense low-boiling-point gases. A cup-shaped radiation shield 138 is joined to the first stage heat station 206*a*. The second stage 122*b* of the cold finger extends through an opening in the radiation shield 138. This shield surrounds the second stage array 120 to the rear and sides of the array to minimize heating of the array by radiation. Preferably, the temperature of this radiation shield 138 is less than about 130 K.

A secondary pumping surface includes a frontal orifice plate 210, which is in thermal contact with the radiation shield 138, serving as both a radiation shield for the second stage pumping area and as a cryopumping surface for higher condensing temperature gases. The orifice plate 210 has a plurality of holes 212 that restrict flow of low-boiling-point gases to the second stage array 120.

The orifice plate acts in a selective manner because it is held at a temperature approaching that of the first stage heat sink (between 77 K and 130 K). While the high-boiling-point gases freeze on the baffle plate itself, the orifices 210 restrict passage of low-boiling-point gases to the second stage 122*b*. Low-boiling-point gases pass through and into the volume within the radiation shield 138 and condense on the second stage array 120. To summarize, of the gases arriving at the cryopump port 202, higher condensing temperature gases are removed from the environment while the second stage pumping surface is restricted to low-boiling-point gases.

Figure 3:
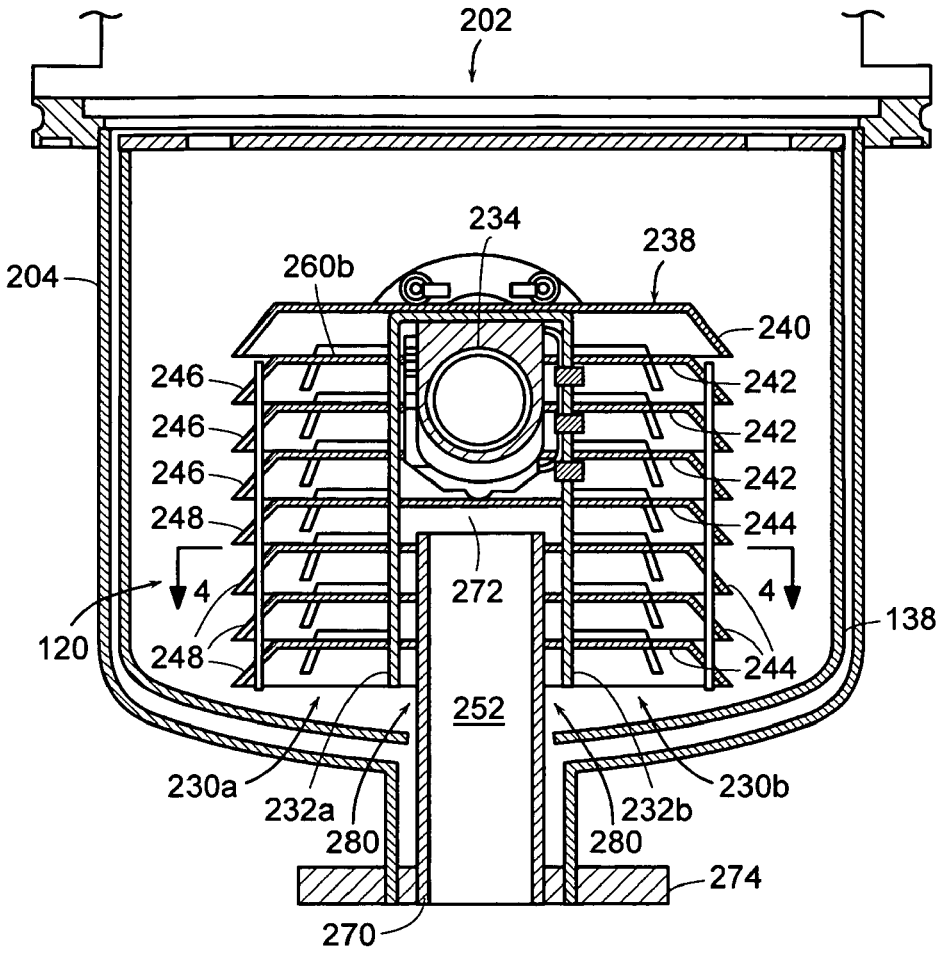
FIG. 3 is a longitudinal sectional view of the second stage array incorporating the present invention taken along a plane perpendicular to the view of FIG. 2

As best shown in FIG. 3, the second stage array 120 is formed of two separate groups of semi-circular baffles 230*a*, 230*b* that are mounted to respective brackets 232*a*, 232*b*, which are in turn mounted to the heat station 260*b*. The brackets are flat L-shaped bars extending transverse to the cold finger 234 on opposite sides of the heat station 260*b*. The array includes three different types of baffles similar to those described in U.S. Pat. No. 4,555,907. A top baffle 238 is a full circular disk having a frustoconical rim 240. The baffle 238 bridges the two brackets 232*a*, 232*b*, and is joined to the heat station 260*b*. The remaining two types of baffles 242, 244 are semicircular and also have frustoconical rims, 246 and 248 respectively. Pairs of baffle 244 form full circular discs; whereas, baffles 242 are cutaway to provide clearance for the second stage 122*b* cold finger 234.

Array of Baffles

The many baffles provide large surface areas for both condensing and adsorbing gases. The brackets 232*a* and 232*b* provide high conductance thermal paths from the baffles to the heat station 260*b*. Preferably, the baffles, brackets and heat station are formed of nickel-plated copper. The baffles remove gases from the process chamber 102 by trapping and immobilizing them on cryogenically cooled surfaces. As gas molecules strike the array surfaces, they are cooled and frozen to those surfaces. A typical single strike capture probability is 0.9 or better. Thus, three strikes onto a cold array surface removes 99.9% of the gases. A region within the array exists where all gases must undergo multiple strikes to reach the region. As such, the pressure within the region is substantially lower than the pressure external to the array, which is in turn, substantially lower than that in the process chamber due to the orifice plate 210. Experiments have shown that the pressure within that region is three to six orders of magnitude less than the pressure in the process chamber, while differences in partial pressure from outside the charcoal array to inside the charcoal array may be two to six or more orders of magnitude.

Adsorbent

Figure 4:
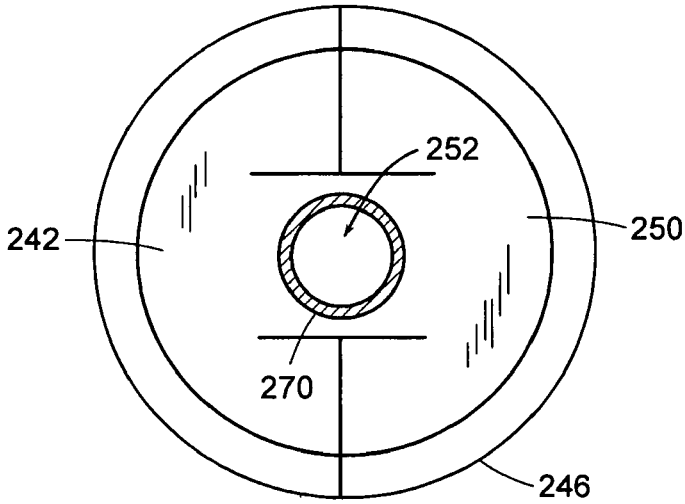
FIG. 4 is a sectional view of second stage array of FIG. 2 taken along line 4-4.

Charcoal adsorbent, a solid at room temperature, may be thermally bonded to the top, flat surfaces of the baffles 242 and 250, as shown in FIG. 4. If a greater amount of adsorbent is required, adsorbent can also be epoxied to the lower surfaces of both the flat regions and the frustoconical rims. The frustoconical rims intercept and condense condensable gases. This prevents the adsorbent from becoming saturated prematurely.

Absorbents, such as charcoal are generally rated in terms of adsorption capacity (i.e., the amount of gas molecules that can be captured). This capacity decreases as the gases accumulate. As the concentration increases, the condensing surfaces become increasingly saturated. The rate of adsorption (i.e., the efficiency) falls as the amount of gas molecules and contaminants captured grows. This decreases the pumping capacity and speed of the cryopump 104.

Determining the Adsorption Capacity with a Total Pressure Gauge

Referring to FIGS. 2 and 3, in order to monitor and predict the absorption capacity, the present invention uses a total pressure gauge sensor 118*a* connected to a duct 252 that extends through the radiation shield 138 into a region surrounded by the second stage array 120, where the adsorbing charcoal is located. More specifically, the member 270 extends through the radiation shield 138 into low pressure region 272 located within the array between the brackets 232*a* and 232*b*. A flange 274 provides a seal between the member 270 and the cryopump housing 204. However, no physical seal exists in the region 280 to isolate the low pressure region 272 from the higher pressure region external to the array. Gas molecules entering the region 280 will either deflect away from the warm member 270 and become trapped on a cold surface of the array or become trapped on one of the brackets 232*a* or 232*b*. As such, no physical seal is required in the region 280.

Rather, a cryoseal maintains the pressure differential of at least two orders of magnitude and as much as six orders of magnitude. Thus, differences in hydrogen partial pressure from outside the charcoal array to inside the charcoal array may be two to six or more orders of magnitude. The member 270 extends through opening 250 in the array of baffles in a direction substantially perpendicular to the baffles. At the distal end of the member, a port or duct 252 is provided for enabling the ion gauge 118*a* access to the low pressure region 272.

Preferably, the total pressure gauge 118*a* is an ion gauge. The ion gauge works by ionization of the gas molecules, and the fine wire collector reduces the low pressure limit due to X-ray emission of electrons, which mimics an ion current. This gauge is sometimes referred to as the Bayard-Alpert gauge. It works well below 10-3 mbar, and has a lower limit typically below 10-11 mbar, depending on the design.

The ion gauge 118*a* is coupled to the member 270 to measure the pressure of low-boiling-point gases in the low pressure region 272. The gauge 118*a* can be used as a charcoal or hydrogen fullness gauge. Even though the gauge 118*a* is nominally sensitive to all gases, it will be exposed only to the low-boiling-point gases because of its location. Because of its location, the total pressure gauge 118*a* measures the partial pressure of low-boiling-point gases during process and recovery independent of the actual chamber or pump 104 total pressure.

Process Pressure and Recovery Pressure

Figure 5:
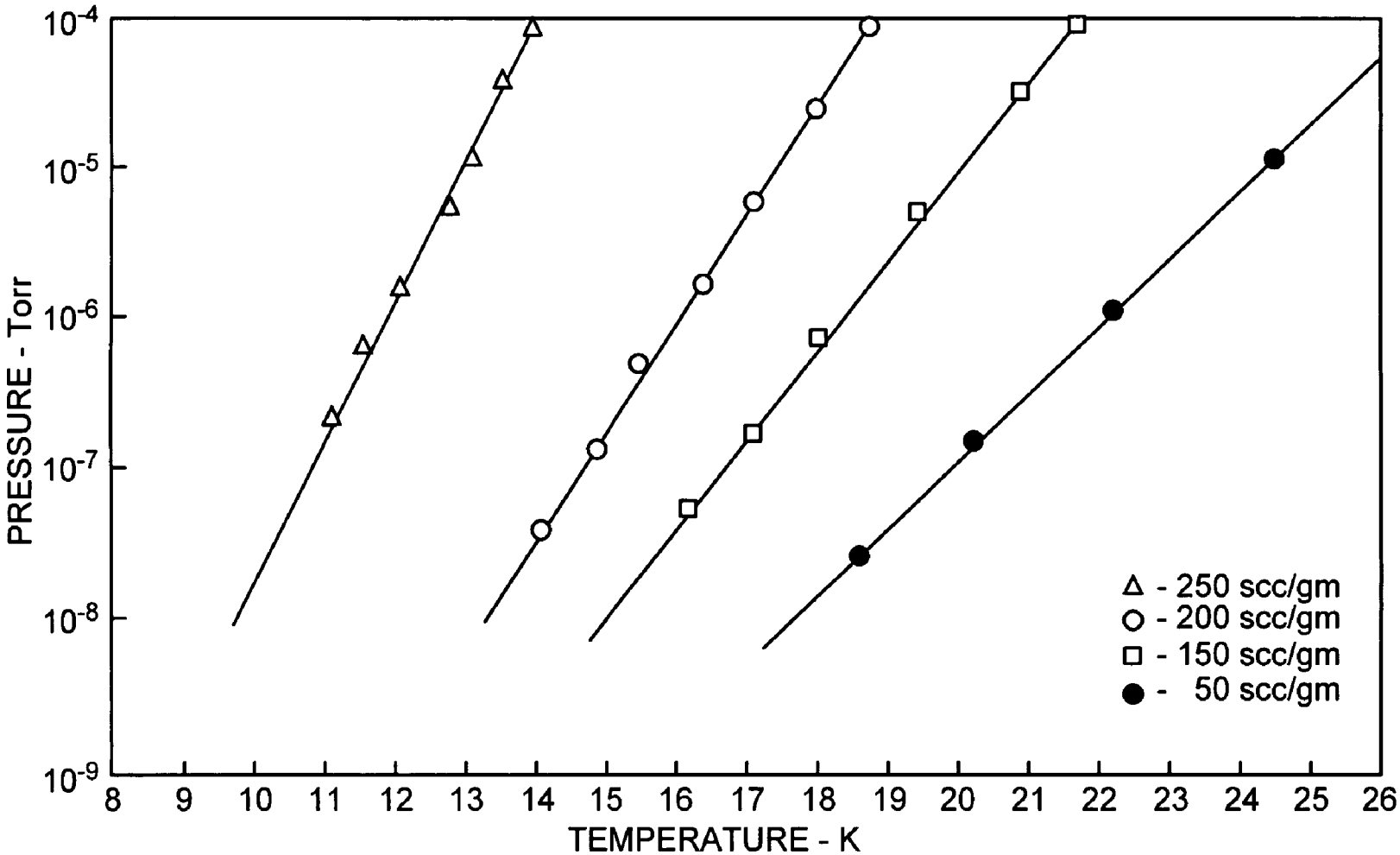
FIG. 5 is a diagram illustrating cryoadsorption isosteres for hydrogen on charcoal.
Figure 6A:
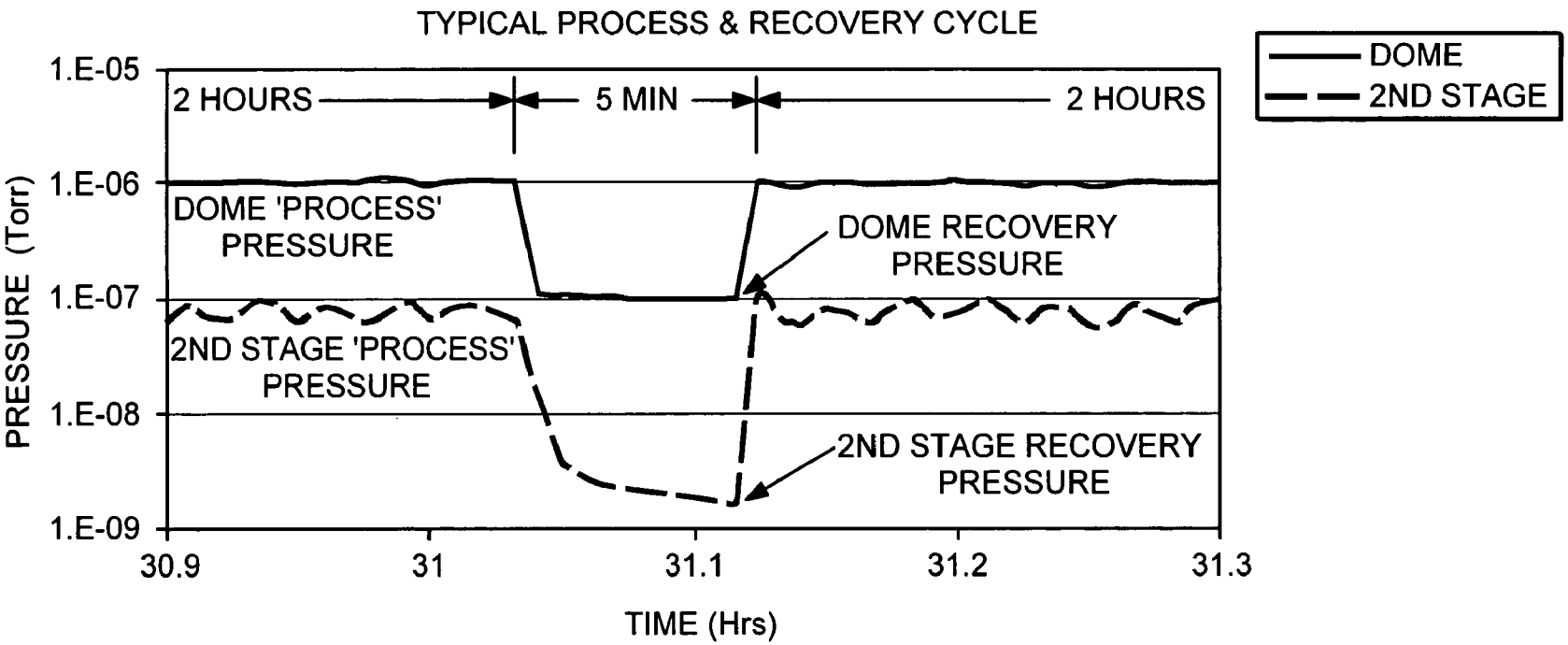
FIGS. 6A-B are diagrams illustrating the typical process and recovery cycles for the process chamber pressure and the second stage pressure.
Figure 6B:
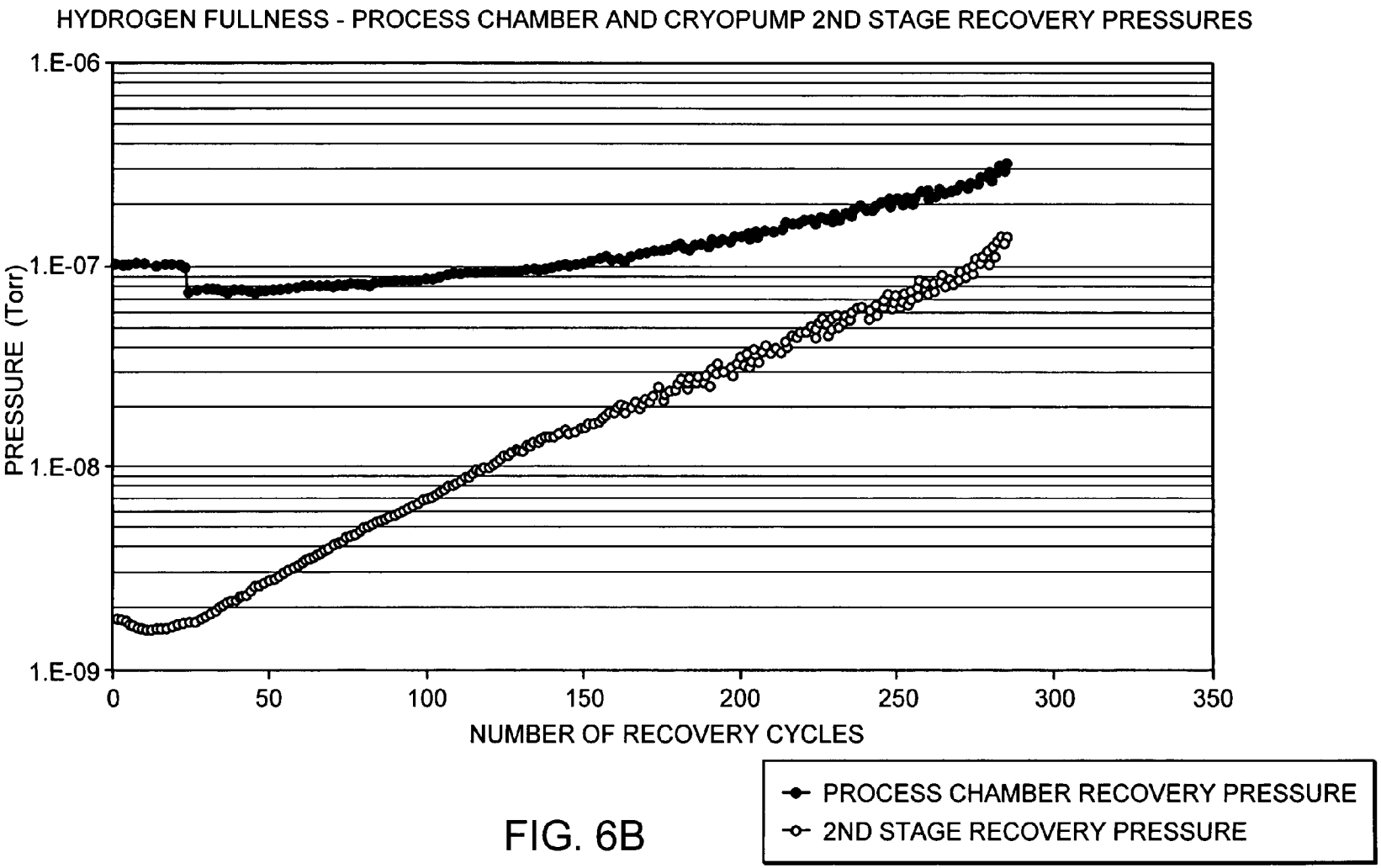

The partial pressure of hydrogen is an indicator of fullness. FIG. 5 is a diagram illustrating cryoadsorption isosteres for hydrogen on charcoal. The cryoadsorption isosteres show that the partial pressure of hydrogen rises for a given temperature as more hydrogen is adsorbed. As shown in FIGS. 6A-B, the recovery partial pressure rises in proportion to the amount of hydrogen adsorbed during process time. For example, the partial pressure of hydrogen rises while wafers are coated with photoresist and are implanted with ions due to the decomposition of the photoresist.

Initially, hydrogen partial pressure is a very small fraction of the total pressure and is insignificant in system operation. As the pump adsorbs more hydrogen during process cycles, the hydrogen partial pressure within the pump recovers to a very low level that, during continued operation, slowly rises to a higher level with accumulations of successive cycles. The total pressure during recovery rises due to the larger hydrogen contribution. Eventually, hydrogen becomes the dominant system gas in the cryopump limiting recovery pressure. The recovery pressure in the second stage of the pump is significantly lower than the base pressure of the dome (process chamber). As a result, the cryopump second stage recovery pressure has more sensitivity to hydrogen levels.

As shown in FIG. 1, the cryopump is coupled to an electronic controller 126. The electronic controller 126 can measure pressure with the pressure sensor 118*a* and use this pressure measurement to determine whether the pump 104 has reached its hydrogen pumping capacity. The controller 126 can detect a rise in pressure sensed by the pressure sensor 118*a*, and this can be communicated 176 to the host control system 106. By measuring pressure with the pressure sensor 118*a*, the controller 126 can measure low-boiling-point gas pressure during process and recovery independent of the total pressure of the actual chamber or pump 104. With the measured pressure from the pressure sensor 118*a*, the controller 126 can use logic to determine when the pump is approaching its hydrogen pumping capacity. For example, if the pressure sensor 1118*a* indicates that there is a rise pressure in the second stage array to $5\times10^{-6}$ torr during recovery, this might signify that the pump 104 had reached capacity. The pressure ratio of the process chamber 102 pressure measured by sensor 118*b* and the second stage array 120 pressure measured by the sensor 118*a* can also be considered when determining whether the pump 104 has reached its pumping capacity.

While the invention has been particularly shown and described with reference to preferred embodiments thereof, it will be understood by those skilled in the art that various changes in form and details may be made without departing from the spirit and scope of the invention as defined by the appended claims. For example, although a flat pump is shown, the invention may be used with a cryopump in which the refrigerator cold finger is coaxal with the array. The advantage of the system shown is that the array configuration of U.S. Pat. No. 4,555,907 leaves an open volume between the brackets 232*a* and 232*b*. The only modification to the cryopump is the cylinder member 270 extending through the base of the housing 204 and radiation shield 138.

What is claimed is:

1. A method of measuring fullness of a cryopump that evacuates a processing volume comprising:

coupling a total pressure gauge in direct fluid communication with an inner vacuum region behind a condensing surface distinct from an outer vacuum region outside the condensing surface, the inner vacuum region including an adsorbent for adsorbing non-condensable gases in a cryopump;

during processing or recovery from processing cycles, measuring pressure of the inner vacuum region with the pressure gauge, the measured pressure being substantially less than the pressure in the outer vacuum region outside of the condensing surface; and determining an adsorption capacity of the adsorbent using the measured pressure.

2. A method as in claim 1 wherein the pressure gauge is an ion gauge.

3. A method as in claim 1 wherein coupling the pressure gauge in fluid communication with the inner vacuum region includes connecting the pressure gauge to a tube or duct leading to the inner vacuum region.

4. A method as in claim 1 further including adsorbing gases at the condensing surface, the adsorbed gases consisting substantially of non-condensable gases.

5. A method as in claim 4 wherein non-condensable gases include at least one of hydrogen, helium or neon.

6. A method as in claim 1 wherein the inner vacuum region behind the condensing surface has a pressure which is at least one order of magnitude less than a process chamber coupled to the cryopump.

7. A method as in claim 1 wherein the inner vacuum region further includes an array of baffles coated with an adsorbent.

8. A method as in claim 1 wherein the cryopump further includes first and second stage arrays cooled by a refrigerator, the second, colder stage further including the condensing and adsorbing surfaces.

9. A method as in claim 8 wherein a partial pressure of hydrogen inside the second stage array is lower than a partial pressure of hydrogen outside the second stage array.

10. A method as in claim 1 wherein determining an adsorption capacity of the adsorbent using the measured pressure further includes determining whether the adsorbent has reached its adsorption capacity using the measured pressure.

11. A method as in claim 10 wherein the determining an adsorption capacity of the adsorbent using the measured pressure includes determining an adsorption capacity for non-condensable gases based on the measured pressure.

12. A method as in claim 1 wherein determining an adsorption capacity of the adsorbent using the measured pressure further comprises determining a residual adsorption capacity of the cryopump using the measured pressure.

13. A cryopump comprising:

a closed cycle refrigerator;

a condensing surface cooled by the refrigerator;

a total pressure gauge in direct fluid communication with an inner vacuum region, the pressure gauge sensing pressure, during processing or recovery from the processing cycles, in the inner vacuum region behind the condensing surface distinct from an outer vacuum region outside the condensing surface, the inner vacuum region including an adsorbent;

the sensed pressure being substantially less than the pressure in an outer vacuum region outside of the condensing surface; and an electronic controller determining an adsorption capacity using the measured pressure.

14. A cryopump as in claim 13 wherein the pressure gauge is an ion gauge.

15. A cryopump as in claim 13 wherein the pressure gauge is connected to a tube or duct leading to the inner vacuum region behind the condensing surface.

16. A cryopump as in claim 13 wherein gases are adsorbed within the condensing surface, the adsorbed gases consisting substantially of non-condensable gases.

17. A cryopump as in claim 16 wherein the non-condensable gases include at least one of hydrogen, helium or neon.

18. A cryopump as in claim 13 wherein the inner vacuum region behind the condensing surface has a pressure which is at least one order of magnitude less than a process chamber coupled to the cryopump.

19. A cryopump as in claim 13 further includes first and second stage arrays cooled by the refrigerator, and the second, colder stage further including the condensing and adsorbing surfaces.

20. A cryopump as in claim 19 wherein the condensing surface of the second, colder stage further includes:

a second stage cryopanel surrounded by a radiation shield, the cryopanel having an array of baffles coated with an adsorbent, the baffles being coupled to and in close thermal contact with a heat sink on the second, colder stage.

21. A cryopump as in claim 19 wherein a partial pressure of hydrogen inside the second, colder stage is less than a partial pressure of hydrogen outside the second, colder stage.

22. A cryopump as in claim 20 wherein the electronic controller further includes computer program instructions which determine whether the adsorbent has reached its adsorption capacity based on the measured pressure.

23. A cryopump as in claim 22 wherein the controller includes instructions to determine an adsorption capacity of the cryopump for non-condensable gases based on the measured pressure.

24. A cryopump as in claim 13 wherein the electronic controller further includes computer program instructions which determine a residual adsorption capacity for the condensing surface using the measured pressure.

25. A system for measuring fullness of a cryopump that evacuates a processing volume comprising:

means for coupling a total pressure gauge in direct fluid communication with an inner vacuum region behind a condensing surface distinct from an outer vacuum region outside the condensing surface, the inner vacuum region including an adsorbent for adsorbing non-condensable gases in a cryopump;

means for measuring pressure of the inner vacuum region with the pressure gauge during processing or recovery from processing cycles, the measured pressure being substantially less than the pressure in the outer vacuum region outside of the condensing surface; and means for determining an adsorption capacity of the adsorbent using the measured pressure.

26. A method of measuring fullness of a cryopump that evacuates a processing volume comprising:

connecting a total pressure gauge in direct fluid communication with an inner vacuum region enclosed by cryopumping surfaces distinct from an outer vacuum region outside the condensing surface, the cryopumping surfaces including an adsorbent for adsorbing non-condensable gases;

during processing or recovery from processing cycles, measuring pressure of the inner vacuum region with the pressure gauge, the measured pressure being substantially less than the pressure in the outer vacuum region; and determining an adsorption capacity of the adsorbent using the measured pressure.

27. A method according to claim 26 wherein the pressure gauge is an ion gauge.

28. A method according to claim 26 wherein connecting the pressure gauge in fluid communication with the inner vacuum region includes connecting the pressure gauge to a tube or duct leading to the inner vacuum region.

29. A method according to claim 26 further including adsorbing gases at the cryopumping surfaces of the cryopump, the adsorbed gases consisting substantially of non-condensable gases.

30. A method according to claim 29 wherein the non-condensable gases include any of hydrogen, helium or neon.

31. A method according to claim 26 wherein the inner vacuum region enclosed by cryopumping surfaces has a pressure which is at least one order of magnitude less than a process chamber coupled to the cryopump.

32. A method according to claim 26 wherein the cryopumping surfaces further include an array of baffles coated with an adsorbent.

33. A method according to claim 26 wherein the cryopump further includes first and second stage arrays cooled by a refrigerator, the second, colder stage further including condensing and adsorbing surfaces.

34. A method according to claim 33 wherein a partial pressure of hydrogen inside the second stage array is less than a partial pressure of hydrogen outside the second stage array.

35. A method according to claim 26 wherein determining an adsorption capacity of the adsorbent using the measured pressure further comprises determining whether the adsorbent has reached its adsorption capacity using the measured pressure.

36. A method according to claim 35 wherein determining an adsorption capacity of the adsorbent using the measured pressure includes determining an adsorption capacity for non-condensable gases based on the measured pressure.

37. A method according to claim 26 wherein determining an adsorption capacity of the adsorbent using the measured pressure further comprises determining a residual adsorption capacity of the cryopumping surfaces using the measured pressure.

38. A cryopump comprising:

a cooled condensing surface coated with an adsorbent for adsorbing non-condensable gases;

a total pressure gauge in direct fluid communication with an inner vacuum region behind a condensing surface, the pressure gauge sensing pressure during processing or recovery from processing cycles in the inner vacuum region enclosed by the condensing surface distinct from an outer vacuum outside of the condensing surface, the sensed pressure being substantially less than the pressure in an outer vacuum region outside the condensing surface; and an electronic controller determining adsorption capacity of the adsorbent using the measured pressure.

39. A cryopump according to claim 38 wherein the pressure gauge is an ion gauge.

40. A cryopump according to claim 38 wherein the pressure gauge is connected to a tube or duct leading to the inner vacuum region enclosed by the condensing surface.

41. A cryopump according to claim 38 wherein the adsorbent is used to adsorb gases, the adsorbed gases consisting substantially of non-condensable gases.

42. A cryopump according to claim 41 wherein the non-condensable gases include at least one of hydrogen, helium or neon.

43. A cryopump according to claim 38 wherein the inner vacuum region enclosed by the condensing surface has a pressure which is at least one order of magnitude less than a process chamber coupled to the cryopump.

44. A cryopump according to claim 38 further includes first and second stage arrays cooled by the refrigerator, and the second, colder stage further including the condensing and adsorbing surfaces.

45. A cryopump according to claim 44 wherein the condensing surface of the second, colder stage further includes:

a second stage cryopanel surrounded by a radiation shield, the cryopanel having an array of baffles coated with an adsorbent, the baffles being coupled to and in close thermal contact with a heat sink on the second, colder stage.

46. A cryopump according to claim 45 wherein a partial pressure of hydrogen inside the second, colder stage is less than a partial pressure of hydrogen outside the second, colder stage.

47. A cryopump according to claim 38 further comprising an electronic controller which measures pressure with the pressure sensor, the controller including computer program instructions which determine whether the adsorbent has reached its adsorption capacity based on the measured pressure.

48. A cryopump according to claim 46 wherein the instructions determine an adsorption capacity for non-condensable gases based on the measured pressure.

49. A system for measuring fullness of a cryopump that evacuates a processing volume comprising:

means for connecting a total pressure gauge in direct fluid communication with an inner vacuum region enclosed by cryopumping surfaces distinct from an outer vacuum region outside the cryopumping surfaces, the cryopumping surfaces including an adsorbent for adsorbing non-condensable gases;

means for measuring pressure of the inner vacuum region with the pressure gauge, the measured pressure being substantially less than the pressure in an outer vacuum region;

means for monitoring an adsorption capacity of the adsorbent using the measured pressure; and means for determining that the adsorption capacity of the adsorbent has been reached by detecting, using the measured pressure, a rise in pressure during recovery.

50. A method as in claim 1 wherein the pressure gauge measures the pressure of non-condensable gases without sensing the cryopump total pressure.

51. A cryopump as in claim 13 wherein the pressure gauge measures the pressure of non-condensable gases without sensing the cryopump total pressure.

52. A method according to claim 26 wherein the pressure gauge measures the pressure of non-condensable gases without sensing the cryopump total pressure.

53. A cryopump according to claim 38 wherein the pressure gauge measures the pressure of non-condensable gases without sensing the cryopump total pressure.

54. A cryopump according to claim 38 wherein the electronic controller further includes computer program instructions that determine a residual adsorption capacity for the condensing surface using the measured pressure.

55. A method as in claim 10 wherein determining an adsorption capacity of the adsorbent using the measured pressure further includes determining that the pumping capacity has been reached if a rise in pressure during recovery is detected.

56. A method as in claim 55 wherein the rise in pressure during recovery is detected when there is a rise in pressure behind a second stage array to about $5\times10^{-6}$ torr.

57. A method as in claim 10 wherein determining an adsorption capacity of the adsorbent using the measured pressure includes:

predicting a residual pumping capacity of the cryopump; and communicating the predicted pumping capacity to the host control system.

58. A cryopump as in claim 22 wherein the electronic controller including instructions responsive to a rise in pressure during recovery by determining that the cryopump has reached its pumping capacity.

59. A cryopump as in claim 58 wherein the rise in pressure during recovery is detected when there is a rise in pressure behind the second stage array to about $5\times10^{-6}$ torr.

60. A cryopump as in claim 22 wherein the electronic controller further including instructions for responding to a rise in pressure during recovery by:

predicting a residual pumping capacity of the cryopump; and communicating the predicted pumping capacity to the host control system.

61. A method according to claim 35 wherein determining whether the adsorbent has reached its adsorption capacity using the measured pressure includes determining that the pumping capacity has been reached if a rise in pressure during recovery is detected.

62. A method according to claim 61 wherein the rise in pressure during recovery is detected when there is a rise in pressure behind a second stage array to about $5\times10^{-6}$ torr.

63. A method according to claim 35 wherein determining whether the adsorbent has reached its adsorption capacity using the measured pressure includes:

predicting a residual pumping capacity of the cryopump; and communicating the predicted pumping capacity to the host control system.

64. A cryopump according to claim 47 wherein the electronic controller including instructions responsive to a rise in pressure during recovery by determining that the cryopump has reached its pumping capacity.

65. A cryopump according to claim 64 wherein the rise in pressure during recovery is detected when there is a rise in pressure behind the second stage array to about $5\times10^{-6}$ torr.

66. A cryopump according to claim 47 wherein the electronic controller including instructions responsive to a rise in pressure during recovery that:

predict a residual pumping capacity of the cryopump; and communicate the predicted pumping capacity to the host control system.

* * * * *